US012606897B2

(12) United States Patent
Lu et al.

(10) Patent No.: US 12,606,897 B2
(45) Date of Patent: Apr. 21, 2026

(54) REMOTE LASER DESENSITIZATION SYSTEMS AND METHODS FOR DESENSITIZING ALUMINUM AND OTHER METAL ALLOYS

(71) Applicant: NUtech Ventures, Inc., Lincoln, NE (US)

(72) Inventors: Yongfeng Lu, Lincoln, NE (US); Leimin Deng, Lincoln, NE (US); Chenfei Zhang, Lincoln, NE (US); Shiding Sun, Lincoln, NE (US); Lei Liu, Lincoln, NE (US)

( * ) Notice: Subject to any disclaimer, the term of this patent is extended or adjusted under 35 U.S.C. 154(b) by 41 days.

(21) Appl. No.: 18/597,168

(22) Filed: Mar. 6, 2024

(65) Prior Publication Data

US 2024/0327966 A1 Oct. 3, 2024

Related U.S. Application Data

(60) Division of application No. 16/804,616, filed on Feb. 28, 2020, now Pat. No. 11,946,128, which is a continuation of application No. PCT/US2018/048541, filed on Aug. 29, 2018.

(60) Provisional application No. 62/551,707, filed on Aug. 29, 2017.

(51) Int. Cl.
*C22F 1/04* (2006.01)

(52) U.S. Cl.
CPC ..... *C22F 1/04* (2013.01)

(58) Field of Classification Search
CPC ..... C22F 1/04; C21D 10/00
USPC ..... 148/565
See application file for complete search history.

(56) References Cited

U.S. PATENT DOCUMENTS

| | | | | |
|---|---|---|---|---|
| 5,236,524 | A | 8/1993 | Rawers et al. | |
| 9,315,886 | B1 | 4/2016 | Sethian et al. | |
| 9,394,596 | B2 | 7/2016 | Kramer et al. | |
| 2012/0234439 | A1 | 9/2012 | Kramer et al. | |
| 2014/0053959 | A1 | 2/2014 | Nie et al. | |
| 2016/0108504 | A1* | 4/2016 | Sethian | C21D 1/34 148/565 |

FOREIGN PATENT DOCUMENTS

| | | | | |
|---|---|---|---|---|
| JP | S 61-96027 A * | 5/1986 | | C21D 6/004 |
| WO | WO 2010/053675 A1 | 5/2010 | | |

OTHER PUBLICATIONS

JPS 6196027A Translation (Year: 1986).*

(Continued)

*Primary Examiner* — Danielle M. Carda

(74) *Attorney, Agent, or Firm* — Gerald T. Gray; Leydig, Voit & Mayer, LTD.

(57) ABSTRACT

A method for desensitizing a metal alloy such as an aluminum (Al) alloy is presented. The surface of the alloy is treated by controlled laser beam irradiation. The scanning laser beam heats the alloy to reach a relative low temperature between a solvus temperature and a soften/annealing temperature of the metal alloy to controllably reduce the degree of sensitization (DOS) of the metal alloy. The locally rapid heating and cooling effects produced by scanning the laser can improve the future sensitization resistance of the metal alloy, reduce the average desensitization temperature applied, and maintain the mechanical properties of Al alloy at the same time.

18 Claims, 17 Drawing Sheets

(56) References Cited

OTHER PUBLICATIONS

C.T. Kwok et al., Effect of Laser surface melting on intergranular corrosion behavior of aged austenitic and duplex stainless steels, Corrosion Science 53, 2011, p. 1581-1591 (Year: 2011).*
U.S. Appl. No. 16/804,616, filed Feb. 28, 2020, Patented.
Kwok et al., "Effect of Laser Surface Melting on intergranular Corrosion Behaviour of Aged Austenitic and Duplex Stainless Steels," Corrosion Science, vol. 53, Issue 4, pp. 1581-1591, Apr. 2011.
International Search Report in International Patent Application No. PCT/US2018/048541 dated Dec. 12, 2018.
Written Opinion of International Searching Authority in International Patent Application No. PCT/US2018/048541 dated Dec. 12, 2018.

* cited by examiner

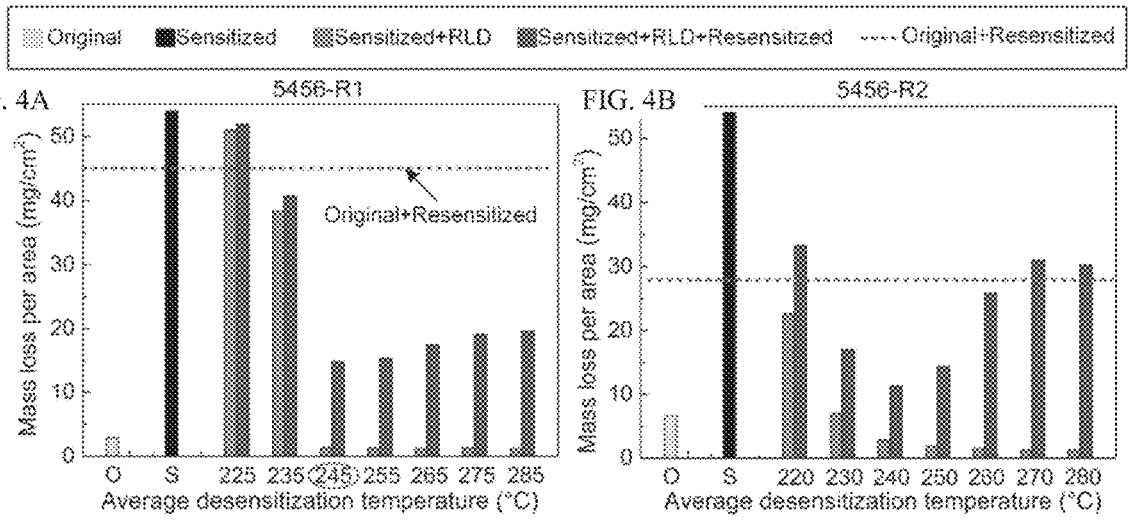
FIG. 4A
FIG. 4B
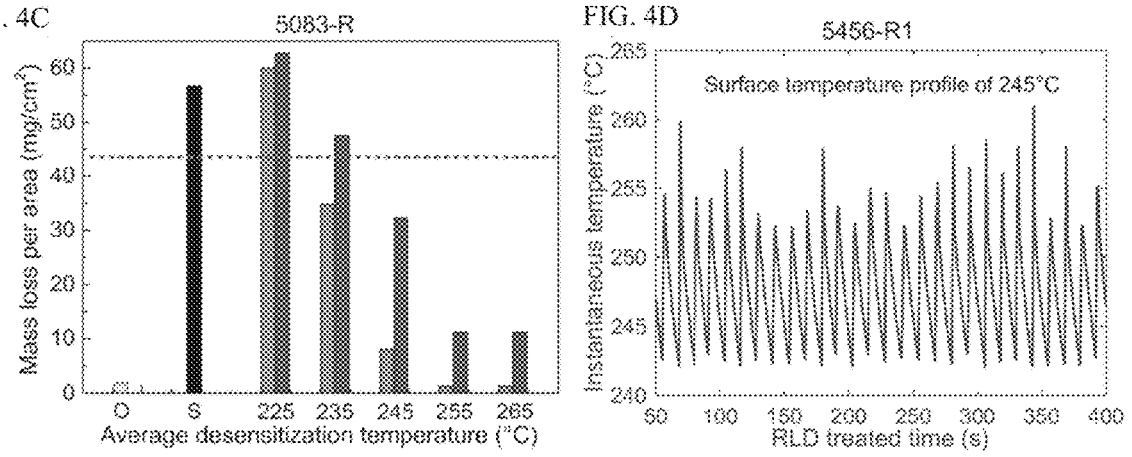
FIG. 4C
FIG. 4D

I: Original sample; S: Desensitization (100 ℃, 7 days);
D : Instantaneous desensitization; RS: Sensitization (150 ℃, 4 h)

I: Original sample; S: Desensitization (100 ℃, 7 days);
D : Instantaneous desensitization; RS: Sensitization (150 ℃, 4 h)

REMOTE LASER DESENSITIZATION SYSTEMS AND METHODS FOR DESENSITIZING ALUMINUM AND OTHER METAL ALLOYS

CROSS REFERENCES

This Patent Application is a Divisional of U.S. application Ser. No. 16/804,616 by Yongfeng Lu et al., entitled "REMOTE LASER DESENSITIZATION SYSTEMS AND METHODS FOR DESENSITIZING ALUMINUM AND OTHER METAL ALLOYS," filed Feb. 28, 2020, which is a continuation of PCT Application No. PCT/US2018/048541 by Yongfeng Lu et al., entitled "REMOTE LASER DESENSITIZATION SYSTEMS AND METHODS FOR DESENSITIZING ALUMINUM AND OTHER METAL ALLOYS," filed Aug. 29, 2018, which claims priority to U.S. Provisional Patent Application No. 62/551,707 by Yongfeng Lu et al., entitled "REMOTE LASER DESENSITIZATION SYSTEMS AND METHODS FOR DESENSITIZING ALUMINUM AND OTHER METAL ALLOYS," filed Aug. 29, 2017, each of which is incorporated herein by reference in its entirety.

FEDERALLY SPONSORED RESEARCH OR DEVELOPMENT

This invention was made with Government support under contract N00014-15-C-0087 awarded by the Office of Naval Research. The Government has certain rights in this invention.

FIELD

The present disclosure relates to treatment of metals, metal alloys, and metal compounds, particularly the Al alloys, to reduce susceptibility to corrosion (sensitization) and enhance resistance for future sensitization. These treatments have significant engineering application in transportation industry (building and maintaining of ship, airplane, vehicle, oil/gas pipeline), nuclear industry (building and maintaining of nuclear power station), construction industry (building and maintaining of steel structure, bridge, and facility), metallurgical engineering (Al alloy manufacture and treatment), aviation industry (metals/alloys for airplane), and others.

BACKGROUND

The 5xxx series aluminum (Al) alloys are widely used in marine environments because they have a combination of high strength, formability, weldability, and corrosion resistance under atmospheric conditions. Since the 1940s, these alloys (5083 and 5456), were used to build high-performance ships, pressure vessels, and aquatic hulls. The relatively high magnesium (Mg) content (>3 wt %) in 5xxx Al alloys provides high mechanical strength by solid solution strengthening, dispersion hardening, and/or work hardening. However, these materials can be sensitized and become susceptible to intergranular corrosion (IGC) when exposed to moderate and even low temperatures (65° C.). This problem gained new attention in 1980s after more than 200 vessels built with 5083 Al alloys were found to be susceptible to IGC cracking. Some of them were even located in areas without obvious stress concentrations. The sensitization of 5xxx Al alloys is caused by the precipitation of a deleterious secondary phase, known as the β-phase ($Al_3Mg_2$), on grain boundaries (GBs) as the Mg is supersaturated in an Al solution. When exposed to harsh environments in service, such as sea water, a galvanic couple is formed between the Al matrix and the β-phase precipitates, leading to preferential dissolution of these precipitates and resulting in IGC cracking.

Based on the phase diagram of the Al—Mg binary system, the β-phase particles can be dissociated and dissolve back into the Al grains by heating the Al alloys to a specific temperature. There are large numbers of studies demonstrated these effects. As illustrated in the plots shown in FIG. 1, such desensitization occurs when the temperature of Al alloys is over 240° C. The dissolving of β-phase requires the heating temperature above the solvus temperatures of materials, and has great relationship with the composition and temper conditions of Al alloys. Generally, the solvus temperature for commercial Al alloys is higher than that of a pure binary Al—Mg alloy. For example, the commercial 5083 Al alloys have an experimentally measured solvus temperature of 290° C., and the 5456 Al alloys should have a solvus temperature of about 260° C.

However, when the Al alloy was heated at temperature over 250° C., the material begins to anneal and soften, which causes the loss of mechanical properties, as illustrated in FIG. 2. The maximal drop of mechanical properties occurs when the temperature of Al alloy reaches 350° C., and does not further drop obviously with the increase of temperature (<550° C.). Standard reference sources suggest 345° C. as the typical annealing temperature for 5xxx series Al alloys. Therefore, the temperature needed to achieve desensitization without obvious mechanical properties loss is generally within the range between 230~345° C. But this temperature should be increased if the high-temperature duration of materials is reduced.

Various methods to heat the Al alloys to this temperature range for desensitization have been proposed, such as ceramic pad heating and friction-stir processing. However, there are obvious problems with these approaches. Both two methods use balky equipment and need to intimate contact the Al alloy and are hard to applied to complicated structures, such as girders or corners, which have a higher risk of stress corrosion cracking (SCC) occurring. Particularly, the pad only can heat very flat surface without irregularities. As the heating process has great relationship with the contact condition, the treating temperature of both these methods are very hard to control, which cause desensitization process unstable and impractical. Meanwhile, the pad heating process is very slow, which produces a large heat affected zone in Al alloys during desensitization, and cause sensitization of surrounding area. The friction-stir processing causes obvious damage of material surface, and also induces very strong mechanical forces that exceed the bearing capacity of Al structures. Both methods cause an obvious loss of mechanical properties in the materials, especially the friction-stir processing. Moreover, the subsequent study indicated that the samples desensitized by these methods were more quickly resensitized, which raise a new risk.

A non-contact desensitization method using pulsed electron beams has been reported, but it can only desensitize a shallow surface of the Al alloys. Even though this method solved the problem of "intimate contact", the distance between the electron beam window and Al alloy is very narrow as the electron beam cannot transmit in air. Most of all, it is almost impossible to manufacture the required output window that can stand the barometric pressure in one side and also allow the electron beam to go through. Therefore, this method also cannot be applied in real engineering, let alone to complicated structures. Meanwhile, as this method uses a pulsed electron beam to heat the Al alloy, there is a drastic temperature distribution within the treating point during the process. It is very hard to control the temperature of Al alloys within 230~345° C., let alone the lower temperature range without loss or degradation of mechanical properties. Therefore, a loss or degradation of mechanical properties of the alloys is expected when using this method. Also, the electron beam desensitization system is cumbersome, as it is hard to move or use in a narrow space such as on ships or in facilities.

Neither these nor any other approaches have been used in industry for the desensitization of Al alloys. Therefore, a solution to solve the sensitization problem of metal alloys, including 5xxx Al alloys, is still lacking.

SUMMARY

The present disclosure provides systems and methods for desensitizing a metal alloy such as an aluminum (Al) alloy. According to certain embodiments, a remote laser desensitization (RLD) technology for Al and other metals or metal alloys is disclosed. The surface of the alloy is treated by controlled laser beam irradiation. In certain embodiments, a scanning laser beam heats the alloy to reach a temperature between a solvus temperature and a soften/annealing temperature of the metal alloy to controllably reduce the degree of sensitization (DOS) of the metal alloy. The locally rapid heating and cooling effects produced by scanning the laser also can improve the resistance to future sensitization of the alloy, reduce the average desensitization temperature applied, and maintain the mechanical properties of the alloy at the same time. Additionally, these methods can advantageously be used to remotely desensitize the material, e.g., from more than several meters away, even through glass or other transparent materials. The RLD can also be optimized to achieve bulk desensitization, surface desensitization, and instantaneous desensitization. The desensitization degrees and sensitization resistance enhancement of the alloys achieved by these methods can be controlled by laser treatment parameters, such as laser power, pulse energy, pulse frequencies, focus characteristics, scanning speed/methods, etc. These technologies can also be used for desensitizing any metals or metal alloys that may be susceptible to IGC, such as stainless steels.

According to an embodiment, a method for remotely desensitizing a metal alloy sample is provided. The method typically includes irradiating a surface of a metal alloy with a controlled laser beam, wherein the laser beam heats a region of the metal alloy sample to a local temperature between a solvus temperature and an annealing temperature of the metal alloy, without heating the bulk of the metal alloy sample, to reduce a DOS of the metal alloy in the region. In certain aspects, the method further includes scanning the controlled laser beam across the surface of the metal alloy sample to reduce a DOS in additional regions of the metal alloy. In certain aspects, the metal allow comprises an Al alloy or any metals or metal alloys that is susceptible to IGC.

According to another embodiment, a method for remotely desensitizing a metal alloy sample is provided. The method typically includes exposing a surface of a metal alloy to a controlled scanning laser beam irradiation having an average laser output power over 10 W or output laser pulse energy over 10 mJ, wherein the surface of the metal alloy is exposed to the laser beam irradiation directly or through one or more coating layers comprising one of a high-temperature-resistant paint, a nonskid layer, or other coatings, wherein the scanning laser beam irradiation heats a large region of the whole metal alloy sample to reach a relative low average temperature between a solvus temperature and a softening/annealing temperature of the metal alloy, and then using the local heating effect produced by the scanning laser spot to further dynamically and locally increase the temperature of a desired location (laser-material interaction location) in the metal alloy sample to desensitize a region of the metal alloy sample, or the entire metal alloy sample, via laser scanning.

According to another embodiment, a method for remotely desensitizing a metal alloy sample is provided. The method typically includes exposing a surface of the metal alloy to a controlled scanning laser beam irradiation having an average laser output power over 10 W or output laser pulse energy over 10 mJ, wherein the surface of the metal alloy is exposed to the laser beam irradiation directly or through one or more coating layers, including high-temperature-resistant paint, nonskid layer, or other coatings, and wherein the scanning laser beam heats a shallow surface layer of the metal alloy at a desired location and depth, which keeps the local temperature in this region between a solvus temperature and an annealing temperature of the metal alloy, without heating the bulk of the metal alloy sample, to reduce a DOS of the metal alloy at the desired location.

According to another embodiment, a method for remotely desensitizing a metal alloy sample is provided. The method typically includes exposing a surface of a metal alloy to a controlled scanning laser beam irradiation having an average laser output power over 100 W or output laser pulse energy over 50 mJ, wherein the surface of the metal alloy is exposed to the laser beam irradiation directly or through one or more coating layers, such as high-temperature-resistant paint, a nonskid layer, or other coating layers, and wherein the scanning laser beam locally heats the entire thickness of the metal alloy at a desired location, which keeps the local temperature of this region between a solvus temperature and an annealing temperature of the metal alloy to reduce the DOS of the metal alloy at the desired location.

Reference to the remaining portions of the specification, including the drawings and claims, will realize other features and advantages of the present invention. Further features and advantages of the present invention, as well as the structure and operation of various embodiments of the present invention, are described in detail below with respect to the accompanying drawings. In the drawings, like reference numbers indicate identical or functionally similar elements.

BRIEF DESCRIPTION OF THE SEVERAL VIEWS OF THE DRAWING(S)

FIGS. 4A-4D shows plots illustrating the mass-loss test results of recrystallized 5456 and 5083 Al alloys after RLD at different average temperatures and resensitized under 100° C. for seven days: FIG. 4A shows 5456-R1; FIG. 4B shows 5456-R2; FIG. 4C shows 5083-R; and FIG. 4D shows a detailed temperature profile example when the average RLD temperature was 245° C.

Figure 5:
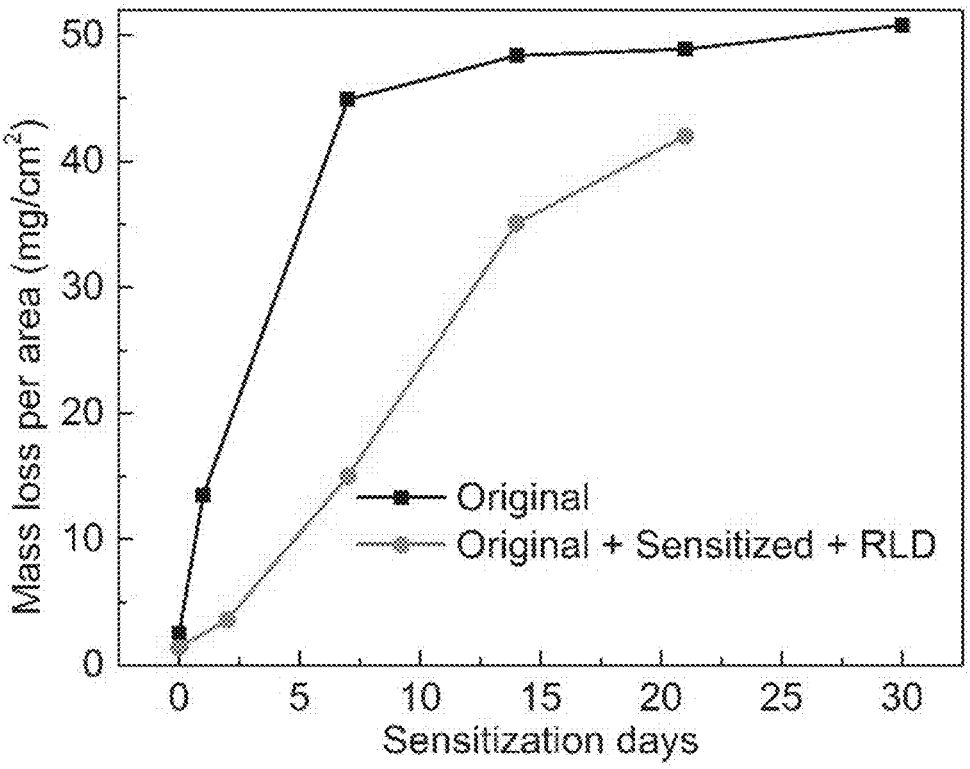

FIG. 5 shows plots illustrating the resensitization behavior of an original Al alloy without RLD and severely sensitized 5456-R1 alloy treated by RLD, which illustrates the improvement that RLD provides to the resensitization resistance of the Al alloy.

Figure 6:
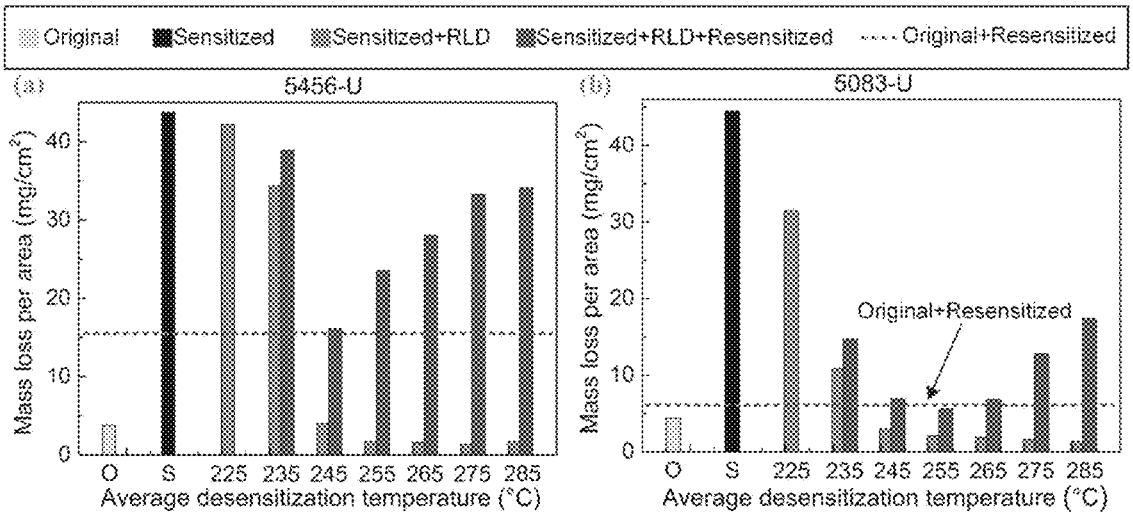

FIG. 6 shows plots illustrating the mass-loss test results of unrecrystallized 5456 and 5083 Al alloys after RLD at different average temperatures and resensitized under 100° C. for 7 days: (a) 5056-U and (b) 5083-U.

Figure 7:
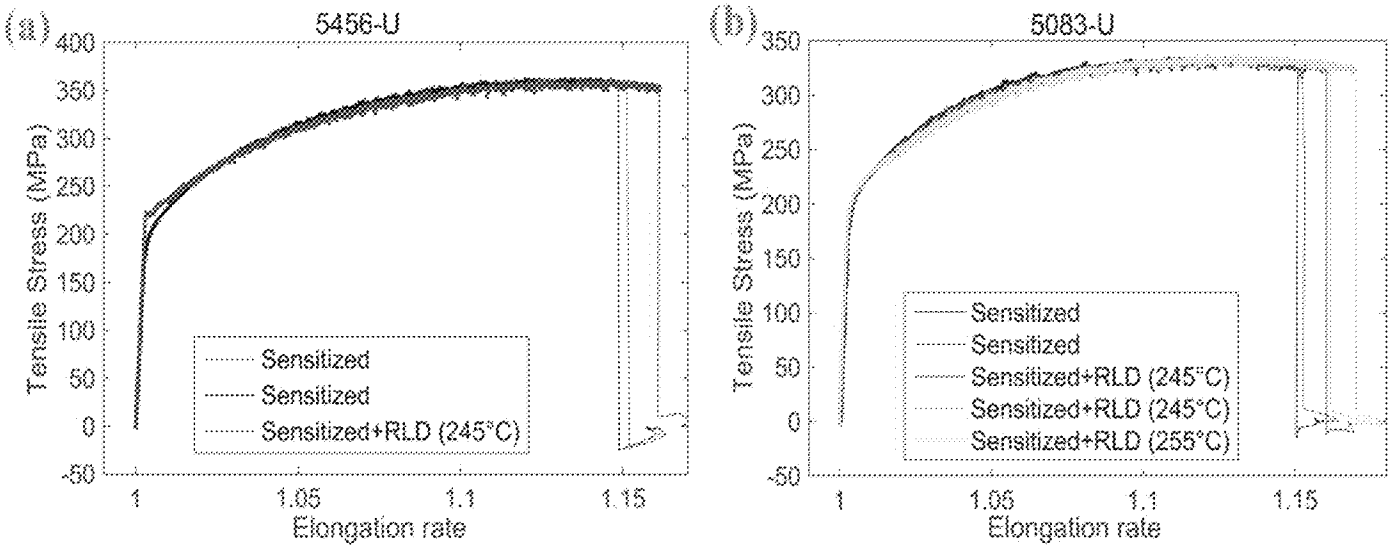

FIG. 7 shows plots illustrating that the use of RLD maintains the yield strength and ultimate tensile strength of the Al alloy after desensitization treatment.

Figure 8:
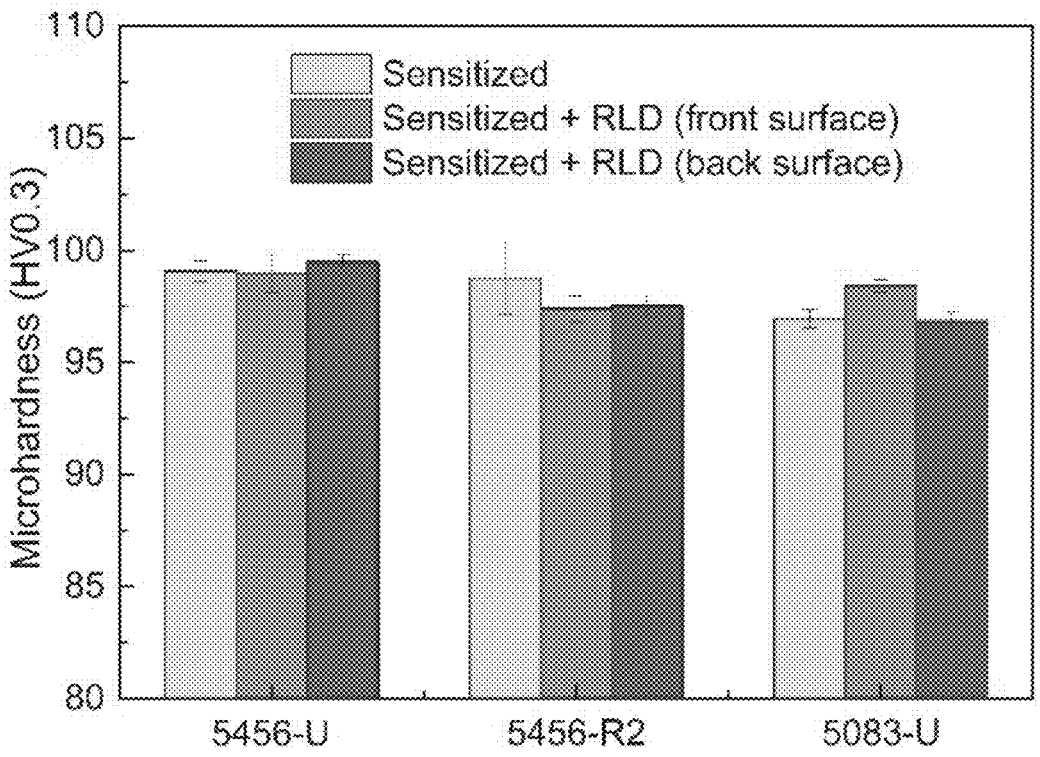

FIG. 8 shows plots illustrating that the use of RLD maintains the hardness of the Al alloy after desensitization treatment.

Figure 9:
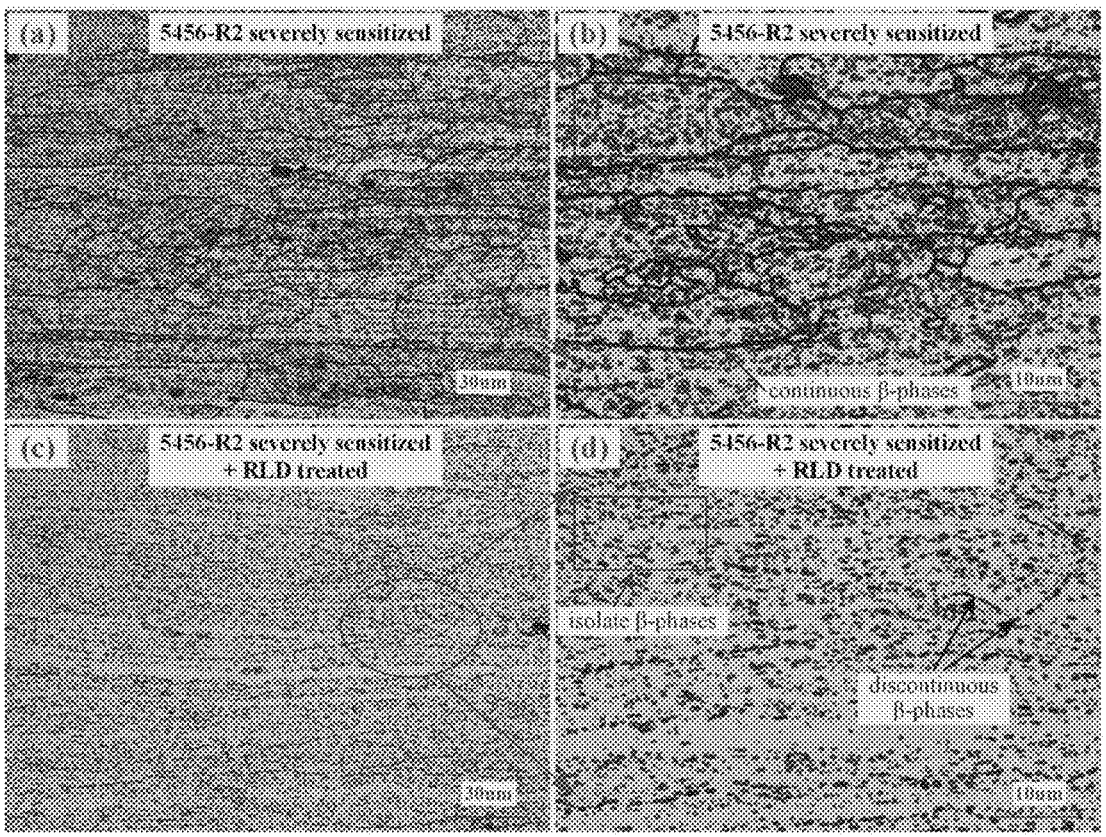

FIG. 9 shows optical cross-sectional metallographic images depicting a 5456-R2 Al alloy before and after RLD in accordance with the present embodiments.

Figure 10:
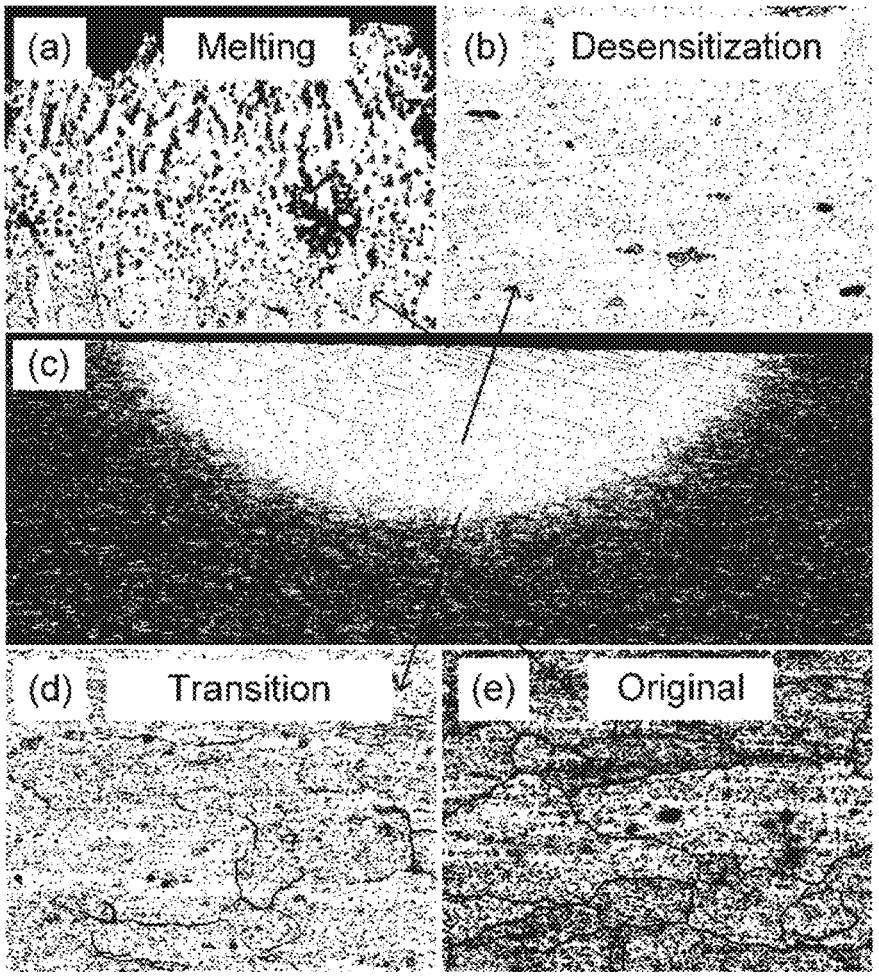

FIG. 10 shows optical cross-sectional metallographic images depicting a 5456-R2 Al alloy after surface RLD in accordance with the present embodiments.

Figure 11:
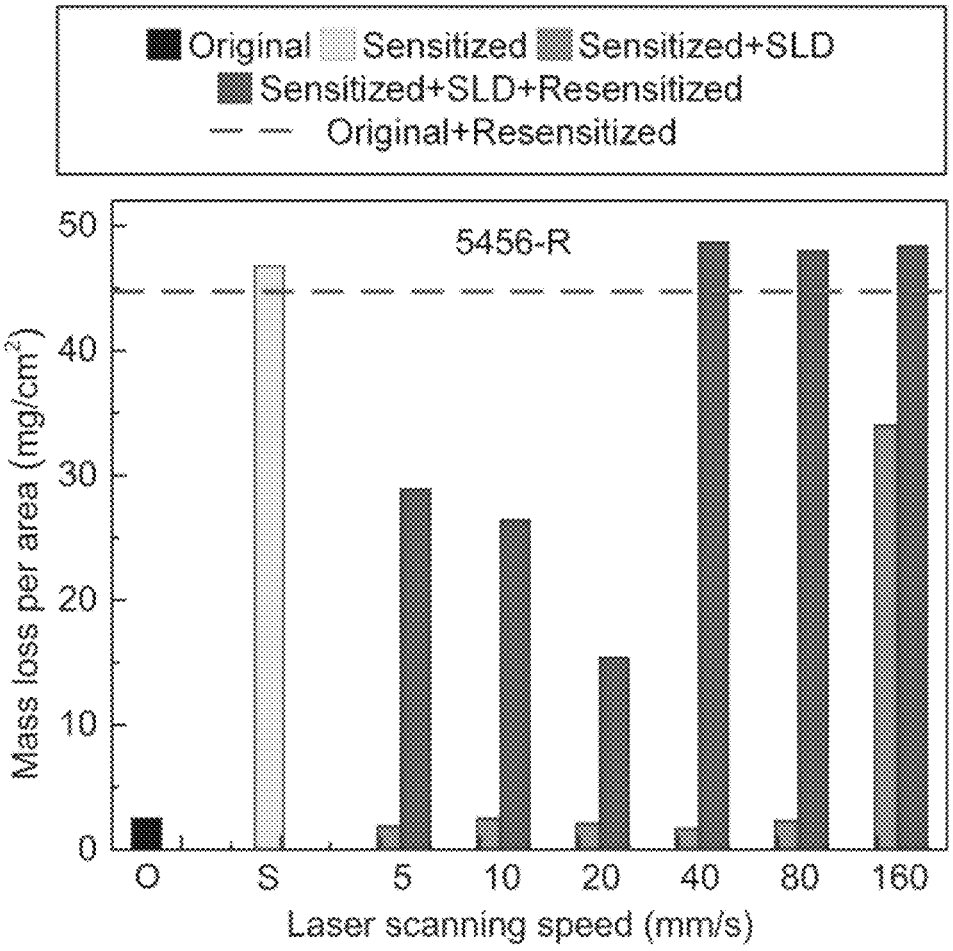

FIG. 11 shows plots illustrating the mass-loss test results of original Al 5456 alloy, severely sensitized 5456 Al alloy, and severely sensitized 5456 Al alloys after surface RLD with different laser scanning speeds and resensitized under 100° C. for 7 days.

Figure 12:
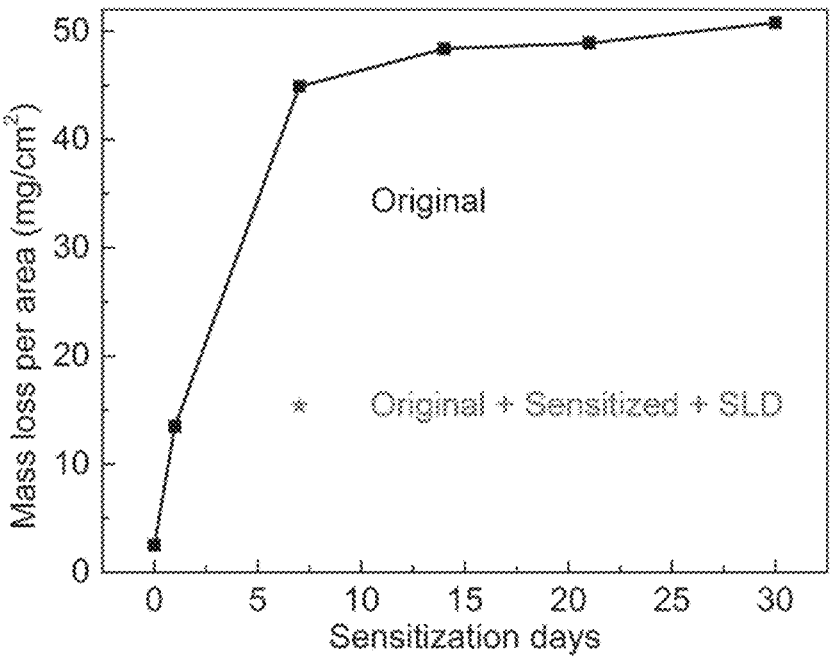

FIG. 12 shows plots illustrating the resensitization behavior of original Al alloy without RLD and severely sensitized 5456 Al alloy treated by surface RLD, which illustrating the improvement surface RLD provides to the resensitization resistance of the Al alloy.

Figure 13A:
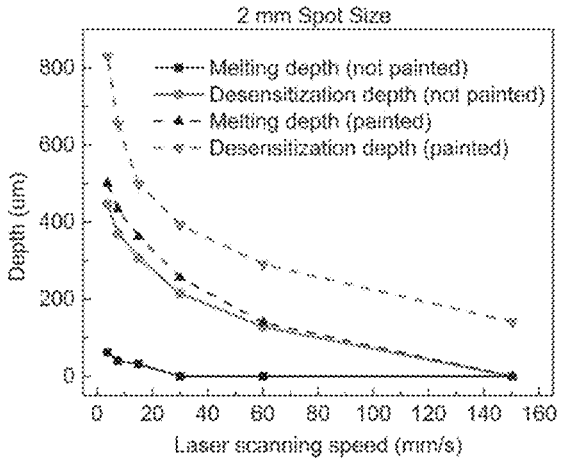
Figure 13B:
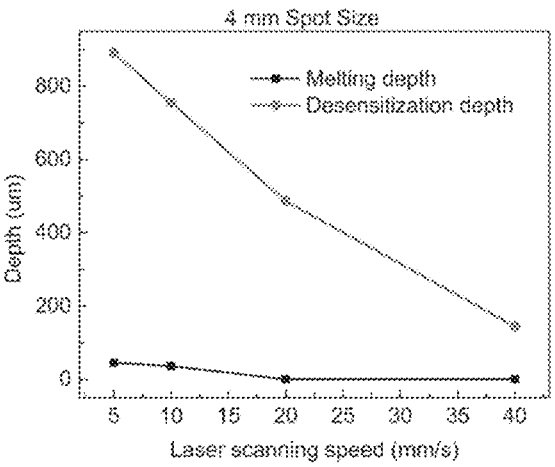

FIGS. 13A-13B shows plots illustrating the melting and desensitization depth produced by different laser scanning speeds and different laser spot sizes during the surface RLD process: FIG. 13A shows a plot for a 2 mm laser spot size; FIG. 13B shows a plot for a 4 mm laser spot size.

Figure 14:
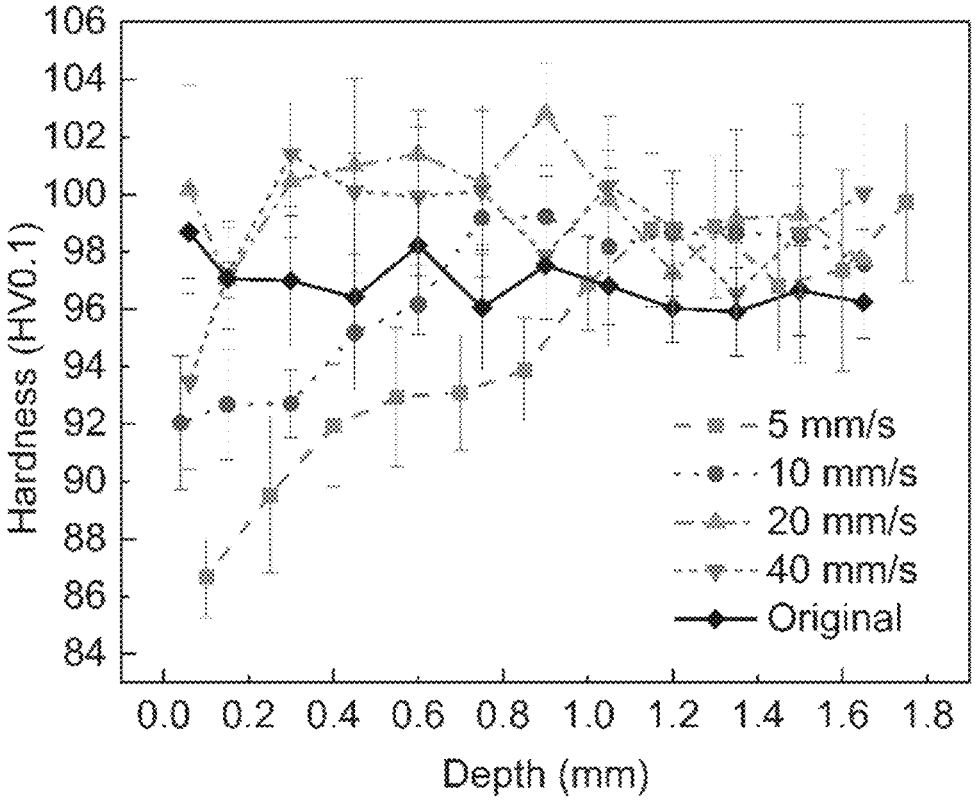

FIG. 14 shows plots illustrating that the use of surface RLD maintains the hardness of the Al alloy after the surface desensitization treatment.

Figure 15:
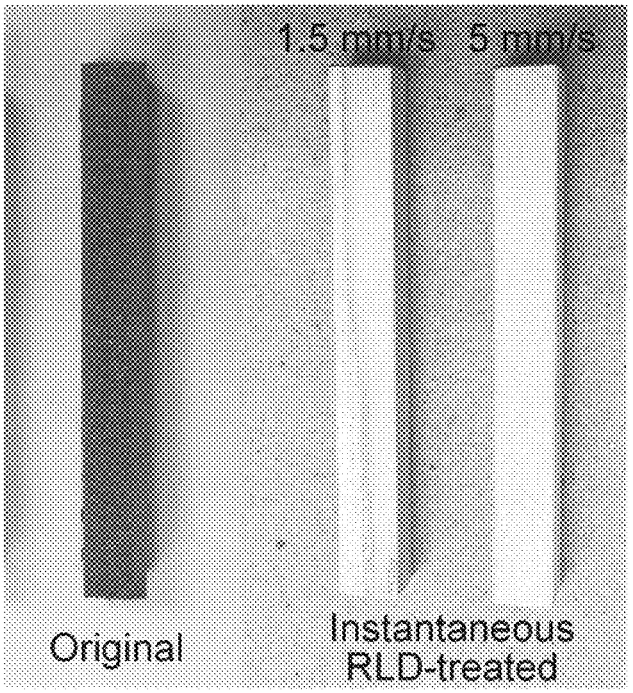

FIG. 15 shows optical images of severely sensitized 5xxx aluminum alloys with and without instantaneous RLD treatment after ASTM G67-13 mass loss test.

Figure 16:
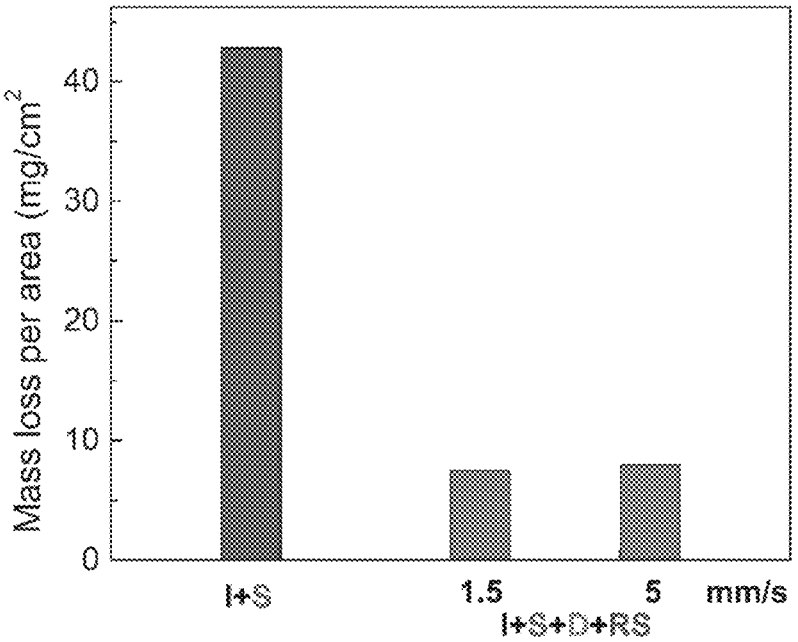

FIG. 16 shows plots illustrating the mass-loss test results of severely sensitized 5456 Al alloys before and after instantaneous RLD with different laser scanning speeds.

Figure 17:
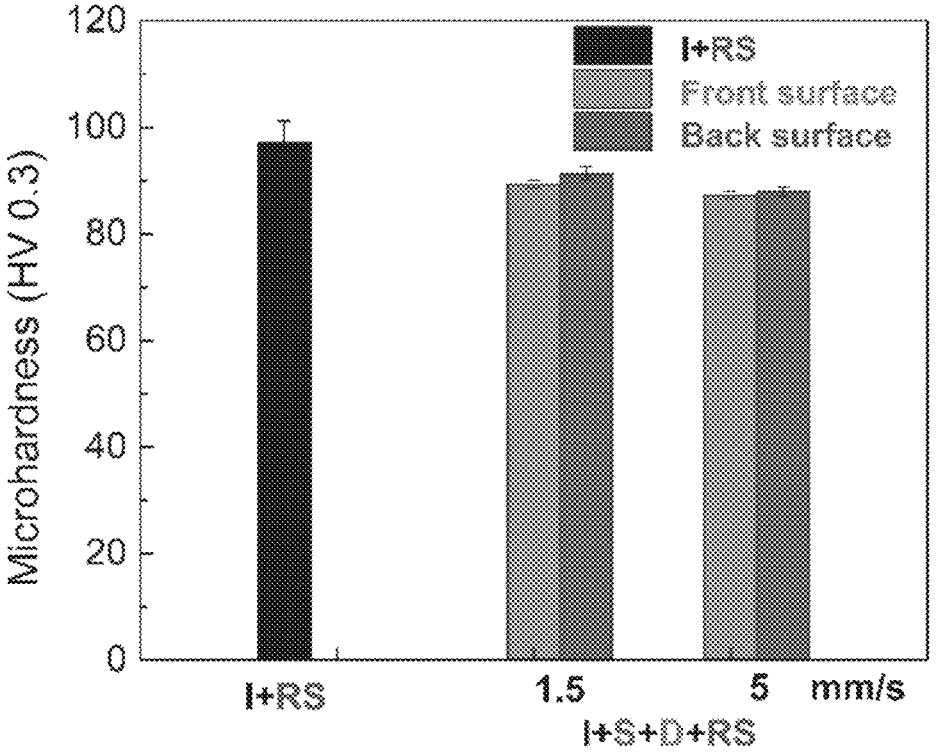

FIG. 17 shows plots illustrating how use of instantaneous RLD maintains the hardness of the Al alloy after instantaneous desensitization treatment.

DETAILED DESCRIPTION

The aspects and features of the present invention summarized above can be embodied in various forms. The following description show, by way of illustration, combinations and configurations in which the aspects and features can be put into practice. It is understood that the described aspects, features, and/or embodiments are merely examples, and that one skilled in the art may utilize other aspects, features, and/or embodiments or make structural and functional modifications without departing the scope of the present disclosure.

Figure 1:
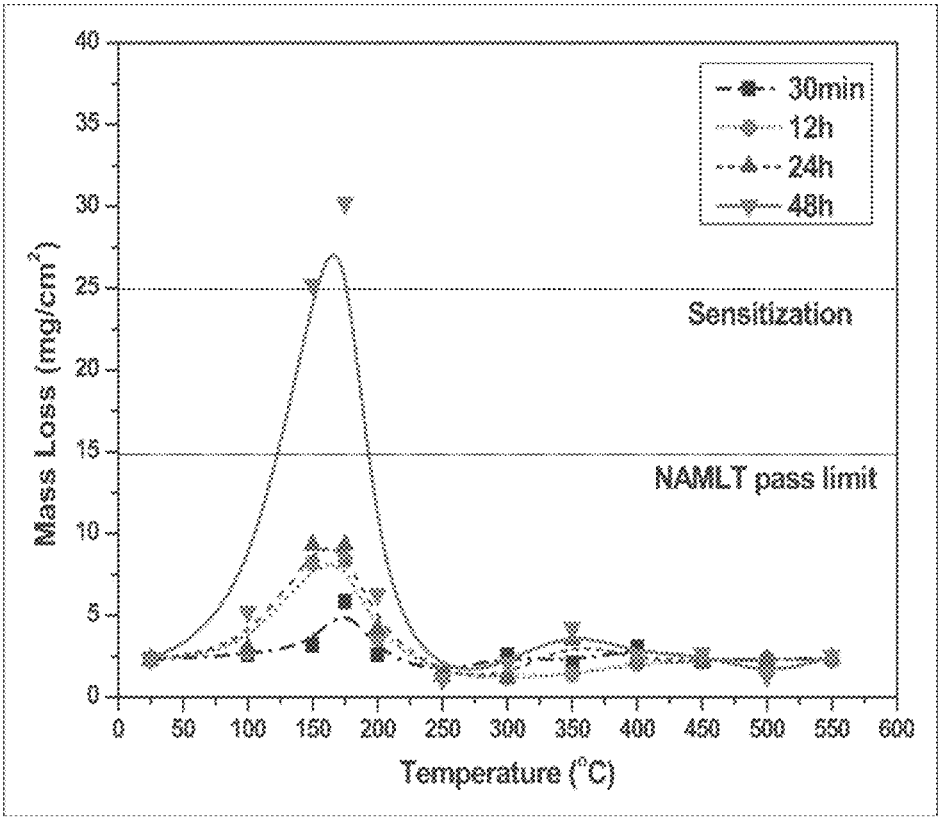
FIG. 1 is a plot illustrating that Al alloys can be desensitized by heating to temperature over about 230~240° C., depending on the alloy type.
Figure 2:
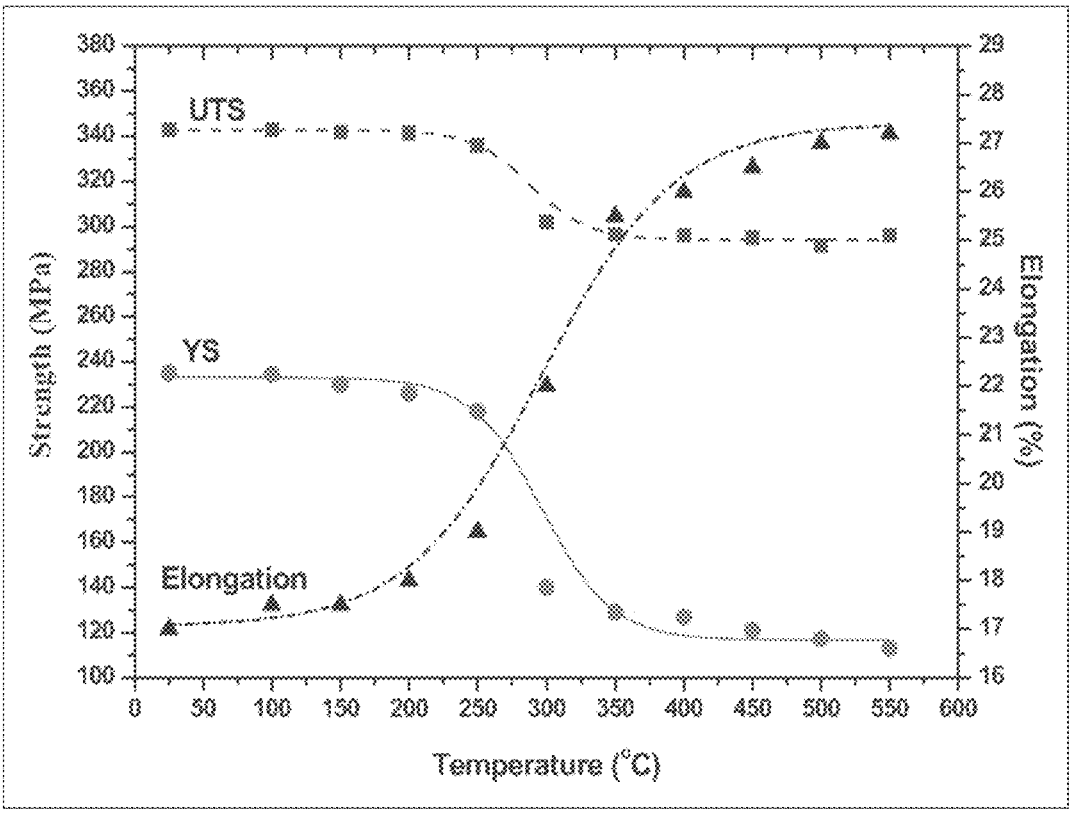
FIG. 2 is a plot illustrating that the mechanical properties of an Al alloy begin to reduce when heated at a temperature over 250° C., and the annealing and softening of material will occur when heated at a temperature over 350° C., depending on the alloy type and the high temperature duration time.

It is well known that the precipitation of β-phase strongly depends on temperature because the content of Mg in 5xxx Al alloys is supersaturated. The precipitation rate of grain boundary β-phase increases with temperature, peaks in the low to mid 100-150° C. range, and then can decrease with temperature increases above that (e.g., 150~210° C.). Within the temperature range of 210~240° C., the precipitation and dissolution of grain boundary β-phase reaches a balance, and the DOS value of the material remains stable. However, the precipitation switches to dissolution with a faster rate (2~4 orders of magnitude faster) when exposed in a temperature over its solvus temperature (about 240° C.); and the dissolution speed increases rapidly with the rise in temperature. Generally, the solvus temperature for commercial Al alloys are higher than that of a pure binary Al—Mg alloy. As illustrated in the plots shown in FIG. 1 and FIG. 2, such desensitization occurs when the temperature of Al alloy is over 240° C., while the annealing and softening of materials also occur when the Al alloys are heated to a temperature over 350° C. Therefore, the temperature needed to achieve desensitization without loss or degradation of mechanical properties will generally be within the range between about 230~345° C., and should be within about 230~270° C. if no loss of mechanical properties is needed or desired. This highest temperature may be increased if the high temperature duration experienced by the material is reduced.

The present embodiments overcome the problems of prior solutions by using a scanning laser beam to heat the alloy, e.g., Al alloys, remotely to desensitize the alloy. As the mechanical properties of 5xxx Al alloys significantly decrease when exposed in an environment over 250° C. for several minutes, as an example, it is undesirable to keep the material in a high temperature environment for a long time for desensitization. The RLD takes advantage of instantaneous high temperatures generated locally by a laser to desensitize the material. The scanning laser beam heats the alloy to reach a relative low temperature (e.g., 230~300° C., depending on alloy type) between a solvus temperature and a soften/annealing temperature of the metal alloy. This keeps the diffusion of Mg in Al alloys at the precipitation and dissolution equilibrium temperature. However, in the region of laser-material interactions, the instantaneous temperature can be 20~100° C. (depending on laser parameters) higher than the bulk material and may last for a short period of time (e.g, several microseconds), which dissolves the β-phase rapidly and cools down to the stable state instantaneously. Therefore, the high-speed dissolution of β-phase can be achieved without heating the whole alloy sample to a high temperature for a long time, which maintains the mechanical properties of the alloy at the same time. The locally rapid heating and cooling effects produced by scanning the laser can also improve the future sensitization resistance of the alloys by influencing the microstructures of the materials. Meanwhile, these methods can be used to remotely desensitize the materials, e.g., from several meters away, even through glass or other transparent materials. The RLD can also be optimized to achieve bulk desensitization, surface desensitization, and instantaneous desensitization. The bulk desensitization uses a laser to desensitize the whole thickness of the material alloy within several minutes, and the surface desensitization only desensitizes a thin layer of material on the metal alloy surface with faster speed. However, the desensitization process can be optimized to instantaneously desensitize using a high energy laser, which is called instantaneous desensitization. The desensitization degrees and sensitization resistance enhancement of the alloys achieved by these methods can be controlled by laser treatment parameters, such as laser power, pulse energy, pulse repetition rate, focus characteristics, scanning speed/methods, etc. These technologies can also be used for desensitizing other metals, metal alloys, metal composites that may be susceptible to intergranular corrosion, such as stainless steels.

Figure 3A:
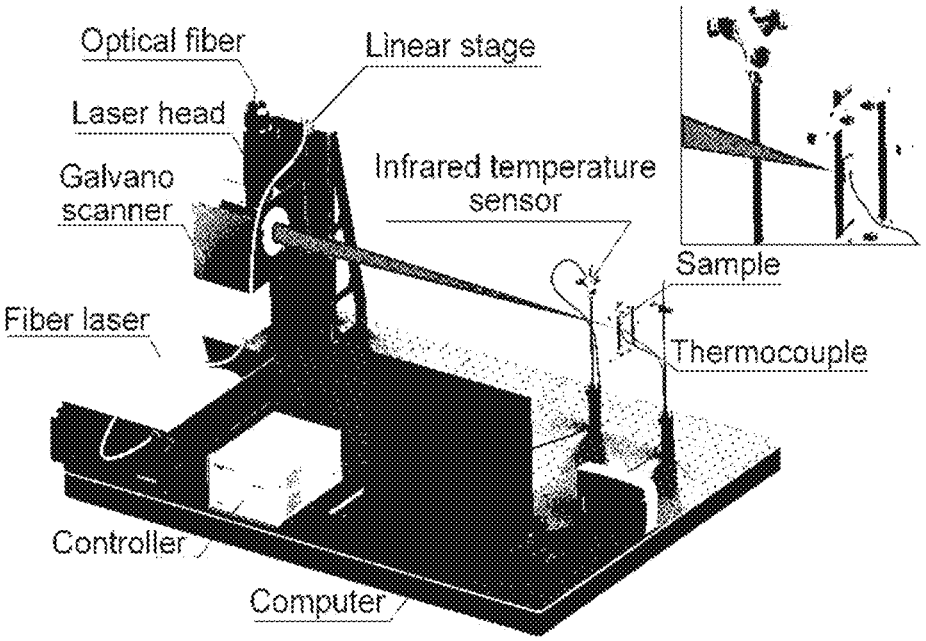
FIG. 3A is a schematic illustrating aspects of an exemplary embodiment of an apparatus for remotely desensitizing a sample, e.g., an aluminum (Al) sample, using a fiber laser.

An example of a setup of a RLD method is shown in FIG. 3A. A continuous wave (CW) fiber laser (it should be appreciated that any other types of lasers with different wavelengths and beam profiles, CW or pulsed, can also be used as a light (or radiation) source as long as they satisfy the desensitization requirements), a Galvanometer scanner, and a dynamic focus system were adopted to focus and scan the laser beam on the sample surface (e.g., metal alloy sample). A thermocouple attached to the backside of the sample measures the average temperature (optional). An infrared (IR) temperature sensor may be used for high-speed monitoring of the instantaneous temperature on the front surface of the sample.

Figure 3B:
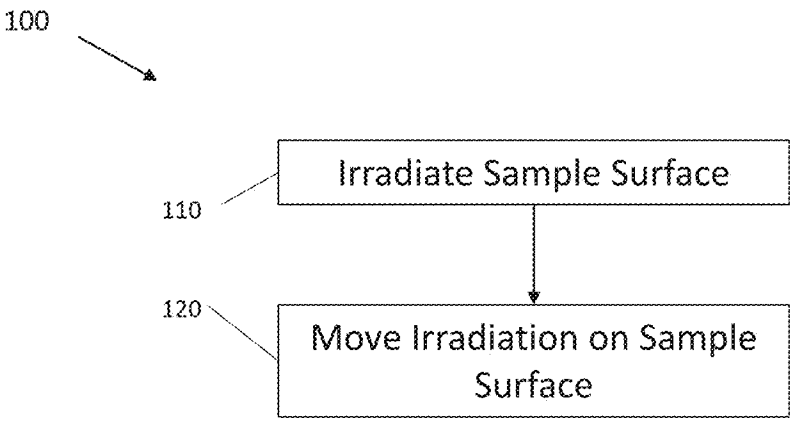
FIG. 3B shows a method for remotely desensitizing a metal alloy sample according to an embodiment.

FIG. 3B shows a method 100 for remotely desensitizing a metal alloy sample according to an embodiment. In step 110, a first region of a surface of a metal alloy sample is irradiated with a controlled laser beam. For example, the surface of the metal alloy sample is exposed to the laser beam irradiation directly, or through a coating layer including a high-temperature-resistant paint, a nonskid layer, or other coating layer(s). The laser beam heats the first region of the metal alloy sample to a local temperature between a solvus temperature and an annealing temperature of the metal alloy, without heating the bulk of the metal alloy sample, to reduce a degree of sensitization of the region of the metal alloy sample in the region. In step 120, the controlled laser beam is moved, or scanned, across the surface of the metal alloy sample to reduce a degree of sensitization in additional regions of the metal alloy. The laser beam heats the region to the local temperature within a certain timeframe, and the scanning includes moving the controlled laser beam to a second region different than the first region after a period of time equal to the timeframe has elapsed. In certain aspect, the second region is contiguous with or abuts the first region, however, the laser may be controlled such that the laser beam interacts with non-contiguous regions, e.g., jumps from region to region. In certain aspects, the metal alloy sample comprises an aluminum (Al) alloy or any metal, metal alloy, and or metal composite that is susceptible to intergranular corrosion (IGC).

As illustrated in FIG. 4, the original 5456-R1 (recrystallized 5456 Al alloy, 9.5 mm thickness) Al alloys are strongly resistant to IGC as the DOS value measured was only 2.9 mg/cm$^2$ (green bar), while the severely sensitized sample was susceptible to IGC cracking due to the high DOS value of up to 54 mg/cm$^2$ (black bar). After RLD treatment at average temperatures of 225 and 235° C. for 10 min, the DOS values of severely sensitized samples decreased slightly, as shown by the red bars in FIG. 4 (*a*). The main reason for this DOS decrease may come from that even though the temperature in the region of the laser-material interaction exceeded the dissolution threshold, the dissolution rate was not high enough and the duration was too short for desensitization. However, a sharp decrease in the DOS value occurred when the sensitized material was RLD treated with average temperatures over 245° C. (solvus temperature), as shown by the red bars in FIG. 4 (*a*). The DOS values achieved by RLD under these conditions were about 1.3 mg/cm$^2$, which was even lower than the initial DOS value of the original material (2.9 mg/cm$^2$) and demonstrated a successful and effective desensitization of severely sensitized Al alloy.

FIG. 4 (*d*) shows the detailed temperature profile during RLD when the average temperature was 245° C. As the temperature fluctuation was in the millisecond scale while the sampling frequency of the infrared temperature sensor was only 1 Hz, the real temperature profile should be sharper. The temperature profile shows that the diffusion of Mg in Al alloys was in a stable state during almost the whole treatment, except for the moment that the material was instantaneously heated to high temperature and produced the desensitization effect.

With the increase in the average RLD temperature, the DOS value only decreased from 1.4 to 1.2 mg/cm$^2$, as shown by the red bars in FIG. 4 (*a*), which indicates that the density of β-phase on the grain boundaries is low enough to not provide a continuous IGC path around grains as the higher average RLD temperatures resulted in faster dissolution rates. Therefore, the further increase in the average RLD temperature is not necessary. On the contrary, the overly high average RLD temperatures may cause issues such as the loss of mechanical properties, as previously mentioned.

According to ASTM B928, the Al alloys with DOS values below 15 mg/cm$^2$ are acceptable for marine service, while the samples with DOS values over 25 mg/cm$^2$ should be rejected. The Al alloys with DOS values between 15~25 mg/cm$^2$ could be used after metallographic examination. Consequently, the results show that the RLD can effectively desensitize severely sensitized 5456-R1 Al alloys to a state even better than the original material without any sensitization.

Since the 5xxx Al alloys desensitized by other methods are resensitized more quickly, the resensitization resistance of the RLD-treated 5456-R1 samples was also investigated. After resensitized in oven at 100° C. for seven days, the original (as received) samples become high risk of IGC due to the high DOS value of up to 44.9 mg/cm$^2$, as indicated by the purple dash line in FIG. 4 (*a*). However, the DOS value of the RLD-treated samples after resensitization was as low as 14.9 mg/cm$^2$, as indicated by the blue bar in FIG. 4 (*a*), which means that these samples would be useful in service even after a cycle of resensitization.

FIG. 5 compares the sensitization resistance of the original 5456-R1 and severely sensitized 5456-R1 samples treated by RLD. The sensitization of the RLD-treated samples was obviously slower than that of the original samples, which took three times longer to reach the same DOS value in the same sensitization environment (100° C.). The results indicate that the RLD can not only reverse the sensitization of Al alloys with high efficiency but also it achieves a strong resensitization resistance far exceeding the original materials. Therefore, RLD can enhance the sensitization resistance of the original Al alloys.

The resensitization resistance of the RLD-treated samples was strongly dependent on the average desensitization temperature, as indicated by the blue bars in FIG. 4 (*a*). Once a relatively low DOS value was achieved by RLD, the resensitization resistance of the treated sample decreased with further increases in the average RLD temperature. This may have been caused by the change in the desensitization mechanism. The RLD mechanism was predominant when the average temperature was low, while the annealing plays a role when the average temperature was high, which led to very low desensitization resistance.

FIG. 4 (*b*) and (*c*) shows the mass-loss test results of the 5456-R2 (recrystallized 5456 Al alloy, 6.3 mm thickness)

and 5083-R (recrystallized 5083 Al alloy, 9.5 mm thickness) series Al alloys after RLD and resensitization under the same condition. Similar results were observed to have high desensitization efficiency and strong resistance to further resensitization. The optimal average RLD temperature for the 5456-R2 alloy was lower (240° C.), while it was higher for the 5083-R alloy (255° C.). The DOS value of the 5456-R1 Al alloy dropped drastically from 38 to 1.6 mg/cm$^2$ when the RLD temperature was raised from 235 to 245° C., while the 5456-R2 and 5083-R dropped more gradually. On the other hand, the resensitization resistance of the RLD-treated 5456-R2 alloys seemed to be more sensitive to the average RLD temperature, as shown in FIG. 4 (*b*).

The unrecrystallized Al alloys have stronger resistance for sensitization. Therefore, low DOS values of 15.2 and 5.3 mg/cm$^2$ were measured, respectively, from the original 5456-U (unrecrystallized 5456 Al alloy) and 5083-U (unrecrystallized 5083 Al alloy) series Al alloys after being sensitized under 100° C. for 7 days, as shown by the purple dashed lines in FIG. 6.

RLD also has a strong desensitization effect on these Al alloys, which reduces DOS values of severely sensitized the 5456-U alloys from 43.7 to about 1.4 mg/cm$^2$ and 44.5 to 1.6 mg/cm$^2$ for the 5083-U alloy, as shown by the red bars in FIG. 6. The best DOS value obtained from resensitization of the RLD-treated samples was equal to that of the original samples, which indicates that RLD can recover the severely sensitized unrecrystallized 5456 and 5083 alloys back to their original status.

FIG. 7 shows the tensile test results of the unrecrystallized 5456 and 5083 Al alloys before and after RLD with the optimal parameters (245° C.), which indicates that there is no decrease in the ultimate tensile strength and yield strength after RLD. Furthermore, the elongation rate of the material improved slightly by RLD, which is beneficial to releasing stress and reducing the potential stress corrosion cracking in service. The surface hardness of the 5456 and 5083 Al alloys before and after RLD was also investigated, as shown in FIG. 8, which indicates that there is no change in the surface hardness after RLD for the Al alloy. Therefore, RLD can desensitize 5456 and 5083 Al alloys without detrimental effect on typical mechanical properties.

The cross-sectional micrographs of the severely sensitized 5456-R2 Al—Mg alloys with/without RLD after being etched in the nitric acid for 2 hours are shown in FIG. 9. The results indicate that the β-phases precipitated in grain boundaries were totally dissolved back into the grains after RLD, which demonstrates a successful desensitization of Al alloys. Some discontinuous β-phases remained in the grain boundaries after RLD, as shown in FIG. 9 (*d*), which are universally identified to significantly reduce the future sensitization of 5xxx Al alloys. It is postulated that the discontinuous β-phases provided nucleation sites for the new precipitation to form large isolated β-phases, suppressing the precipitation and formation of continuous β-phases in grain boundaries which cause the sensitization.

It also shows that the isolated β-phases precipitated inside the grains were also reduced as evidenced by the changes in the grayscale of the images after RLD, as shown in FIG. 9 (*a*) and (*c*). However, the high-magnification cross-sectional micrographs show that the quantity of the isolated β-phases was not obviously reduced while their sizes were markedly reduced after RLD, as shown inside the blue rectangle in FIG. 9 (*b*) and (*d*). Similar to the function of the discontinuous β-phases in the grain boundaries, the isolated β-phases inside the grains also provide nucleation sites to produce more-phase precipitations inside the grains. This effect can reduce the amount of Mg available for precipitation on the grain boundaries which could affect the IGC rate, but does not necessarily reduce the total area coverage of grain boundary that β-phase can form. Therefore, the remaining isolated β-phases have a significant effect on improving the resistance to future sensitization of the Al alloys, which are consistent with the resensitization resistance improvement observed after RLD.

FIGS. 3-9 demonstrate that the RLD method can desensitize the severely sensitized 5xxx Al alloys (whole thickness) to a state that even better than the original materials. The RLD can not only significantly enhance the resistance to future sensitization of RLD-treated Al alloys, but it can also reverse the sensitization with almost no loss of mechanical properties. Meanwhile, this method can remotely desensitize the materials at several meters away, even through the glass or other transparent materials. On the other hand, the RLD can also be optimized to achieve bulk desensitization, surface desensitization, and instantaneous desensitization.

By optimize the laser parameters such as improve the laser power/pulse energy and reduce the laser spot size, the RLD desensitization effect can be confined locally. For example, result in a laser surface desensitization (LSD) of Al alloy. FIG. 10 shows cross-sectional metallographic images of 5456-R2 Al alloy that locally desensitized by LSD. As we know, when laser was scanned on material surface, laser energy was absorbed locally to generate a gradient distribution of temperature and processing time from the center of laser spot to the edge and from the surface to different depth.

In our LSD experiments, obvious difference of desensitization effect at different area due to the temperature and processing time distribution was observed. FIG. 10*c* shows the overall metallographic image on the cross section of a laser scanning line (68% $HNO_3$, 2 hours, ambient temperature). A white semicircular region was observed with a dark background, which is mainly due to the etching of the β-phases on the grain boundaries. With larger magnification, four different regions were identified: melting zone, desensitization zone, transition zone, and sensitization zone, as shown in FIG. 10*a*-10*e*. The sensitization zone is the area without the influence of LSD. In this area, clear grain boundary with corrosion pits can be observed, which means continuous β-phases on the grain boundary and large amounts of Mg-rich particles inside the grains. In the LSD affected zone, the material reflected in three ways due to the difference of processing temperature and time. On the surface of the Al alloy, melting was observed if the laser power density is overwhelming, in which desensitization, recrystallization, annealing, and other grain/phase changes all occurred with a significant change of material property. The black points and lines in FIG. 10*a* might be caused by the black paint involvement and oxidation during melting. The melting zone is also of interest and under further study, which could be avoided if low laser power, fast scanning speed, and low absorption rate were adopted. With the decrease of the processing temperature and time, desensitization was realized solely without melting, contamination, and oxidation, as shown in FIG. 10*b*. In this desensitization zone, no β-phases could be observed on the grain boundaries, which completely dissolved back into the grains. The amount and size of the corrosion pits inside the grains also decreased significantly, showing the decrease of Mg-rich particles. When the processing temperature and time further decreased, some β-phases precipitated discontinuously on the grain boundaries and the corrosion pits also increased in amount and size, which is named the transition zone. The transition zone appears always near the edge of the LSD affected zone and changes gradually to the sensitization region.

As shown in FIG. 11, the original Al alloy samples were strongly resistant to intergranular corrosion (IGC) as the DOS value measured was only 2.5 mg/cm$^2$ (black bar), while the severely sensitized sample was susceptible to IGC cracking due to the high DOS value of up to 46.8 mg/cm$^2$ (green bar). After LSD treatment with a laser power of 400 W, a spot diameter of 4 mm, and scanning speeds of May 10, 2020/40/80 mm/s (red bars), all the DOS values of severely sensitized samples decreased significantly to less than 5 mg/cm$^2$, and even lower than the DOS value of the original material (2.5 mg/cm$^2$), which demonstrate a successful desensitization of severely sensitized samples. Therefore, the LSD can successfully recover the IGC resistance of severely sensitized recrystallized 5456-H116 Al alloys to a state even better than the original material. When the laser scanning speed further increased to 160 mm/s, however, a sharp increase in the DOS value (34 mg/cm$^2$) occurred, which indicates an incomplete desensitization. The LSD processing temperature and affecting time should decrease with the increase of scanning speed. And it is believed that effective LSD only happens with high processing temperature and enough affecting time, since the dissolution rate of β-phases back to grain increases fast with temperature. With a 160 mm/s scanning speed, the affecting time at high temperatures deceases to a level that even the surface of the Al alloy is not completely desensitized, resulting in a high DOS value.

The resensitization resistance of the LSD-treated 5456-H116 samples was also investigated and indicated by the blue bar in FIG. 11. After resensitization in oven at 100° C. for seven days, the DOS value of the LSD-treated samples was as low as 15.4 mg/cm$^2$ with a scanning speed of 20 mm/s. On the other hand, the original sample after sensitization under the same condition obtained a high DOS value of 44.9 mg/cm$^2$, as indicated by the purple dash line in FIG. 11. Therefore, LSD could realize a much better resistance to future resensitization with suitable scanning speed, which means a certain processing temperature and affecting time. With lower scanning speeds of 10 and 5 mm/s, the mass loss of LSD-treated 5456-H116 after resensitization increase gradually to 26.4 and 28.9 mg/cm$^2$, which is still well below the purple line (44.9 mg/cm$^2$). On the contrary, when the scanning speed further increased to 40 mm/s and above, the mass loss after resensitization increased suddenly to over 44.9 mg/cm$^2$. This phenomenon is attributed to the small thickness of the LSD-affected region with higher scanning speed, which is penetrated by nitric acid etching after resensitization and completely dropped off after the corrosion of the non-affected layer undersees the LSD-affected zone.

FIG. 12 shows mass loss values of the original Al alloy sample after a long-term resensitization for 0/2/7/14/21/30 days. We can see that the mass loss increased sharply during the resensitization in the first 7 days' and nearly saturated after that, indicating the importance of the behavior in the first 7 days. As shown by the red star, in the first 7 days, the severely sensitized Al alloy sample after LSD (20 mm/s scanning speed) achieved a much lower mass loss of 15.4 mg/cm$^2$, showing an improved resistance to resensitization.

FIG. 13 shows typical melting and desensitization depth of LSD using different laser scanning speeds, with/without absorptivity enhancing paint, and different laser spot sizes, which demonstrate that the LSP can produce different kind of surface desensitization, such as different desensitizing depth, with/without surface melting, different desensitizing efficiency, and different desensitizing mechanisms (with surface melting, without surface melting, and low melting point element removal via evaporation). By optimize the laser parameters, the LSD process can also maintain the mechanical properties of Al alloys after desensitization, and there is an even surface hardness improvement after LSD, as shown in FIG. 14. Therefore, by optimize the RLD parameters, the desensitization can be achieved on material surface only with perfect desensitization effect, enhanced future resensitization resistance and mechanical properties maintained.

The annealing/soften temperature of Al alloy should be increased if the high temperature duration of material is reduced obviously, and the dissolution speed of grain boundary β-phase increases rapidly with the rise in temperature when it is higher than the solvus temperature [10]. Therefore, using high power/high pulse energy laser to heat the Al alloys to a high temperature and last a very short time can also desensitize the Al alloy instantaneously without obvious loss of mechanical properties.

FIG. 15 shows optical images of severely sensitized 5xxx aluminum alloys with and without instantaneous RLD treatment after ASTM G67-13 mass loss test, which demonstrate that the instantaneous RLD treatment can improve the IGC resistance of Al alloy significantly. FIG. 16 shows the mass-loss test results of severely sensitized 5456 Al alloys before and after instantaneous RLD with different laser scanning speeds. As the laser spot used is 10 mm, while the high-temperature region may only be located within 1~2 mm diameter, the duration of high-temperature time locally is only 200~400 ms. The results demonstrate that the instantaneous RLD can successfully desensitize the whole pieces of severely sensitized 5456 Al alloys instantaneously. The surface hardness of the instantaneous RLD-treated 5456 Al alloys is shown in FIG. 17, and illustrates that the instantaneous RLD can also maintain the mechanical properties of Al alloys at the same time.

EXAMPLES

These and other aspects of the invention will now be described in the context of the following Examples. It will readily be appreciated by one skilled in the art that the following description is merely exemplary, and 5xxx series aluminum and/or other metals, metal alloys, and metal composites may be desensitized in accordance with the method of the present invention through the application of lasers having other laser power, pulse energy, repetition rate, focal length, spot size, scanning speed and so on.

Example case 1: a high-temperature-resistant paint (B'laster 8-GS) was sprayed on the sample surface to increase the light absorptivity of Al alloys. A CW fiber laser beam with a 400 W power and a 4 mm diameter spot size was scanned over the severely sensitized 5456-R1 Al alloy surface with a 5 m/s moving speed and a 0.4 mm line-to-line distance. The distance between the laser scanner and the Al alloy was kept at about 1 meter. The average temperature (240~250° C.) of Al alloy was kept for 10 minutes by turning the laser on and off. After the RLD treatment with these parameters, the whole piece of Al alloy was desensitized, and the DOS value of the severely sensitized 5456-R1 Al alloy decreased from 54 to 1.3 mg/cm$^2$, even better than the original 5456-R1 Al alloy that not been sensitized (2.9 mg/cm$^2$). The RLD-treated 5456-R1 Al alloy was further resensitized at 100° C. for seven days, together with an original 5456-R1 Al alloy that had not been sensitized. The resensitization results indicate that the DOS value of RLD-treated severely sensitized 5456-R1 Al alloy only increased to 14.9 mg/cm$^2$, while the DOS value of the original 5456-R1 Al alloy increased to 44.9 mg/cm$^2$ after resensitization. Meanwhile, the mechanical properties of RLD-treated severely sensitized 5456-R1 Al alloy maintains the same as the status before the RLD treatment.

Example case 2: A CW fiber laser beam with a 400 W power and a 4 mm diameter spot size was scanned over the severely sensitized 5456-R1 Al alloy surface with a 20 mm/s moving speed and a 0.6 mm line pitch. The distance between the laser scanner and the Al alloy was kept at about 0.5 meter. The laser was only scanned once on Al alloy surface. After the surface RLD treatment with these parameters, a desensitization layer with about 0.5 mm depth was produced on severely sensitized 5456-R1Al alloy surface, and the DOS value of the RLD-treated surface decreased from 54 to about 1.8 mg/cm$^2$, even better than the original 5456-R1 Al alloy that had not been sensitized (2.9 mg/cm$^2$). The surface RLD-treated 5456-R1 Al alloy was resensitized at 100° C. for seven days, together with an original 5456-R1 Al alloy that not been sensitized. The resensitization results indicate that the DOS value of RLD-treated severely sensitized 5456-R1 Al alloy only increased to 15.2 mg/cm$^2$, while the DOS value of the original 5456-R1 Al alloy increased to 44.9 mg/cm$^2$ after resensitization. Meanwhile, the mechanical properties of surface RLD-treated severely sensitized 5456-R1 Al alloy maintains the same as the status before RLD treatment. And the surface hardness even increased slightly compared to the status without desensitization.

Example case 3: a high-temperature-resistant paint (B'laster 8-GS) was sprayed on the sample surface to increase the light absorptivity of Al alloys. A CW fiber laser beam with a 400 W power and a 10 mm diameter spot size was scanned over the severely sensitized 5456-H116 Al alloy surface with 1.5 mm/s moving speed and 0.35 mm line pitch. The distance between the laser scanner and the Al alloy was kept at about 1 meter. The dimension of 5456-H116 Al alloy is 50×25×6.5 mm$^3$. The laser was only scanned once on Al alloy surface to perform instantaneous RLD. After the instantaneous RLD treatment with these parameters, the whole thickness of the severely sensitized 5456-H116 Al alloy was desensitized. The DOS value of the instantaneous RLD-treated Al alloy decreased from 42 to about 1.8 mg/cm$^2$, even better than the original 5456-H116 Al alloy that had not been sensitized (5.1 mg/cm$^2$). Meanwhile, the mechanical properties of instantaneous RLD-treated severely sensitized 5456-R1 Al alloy almost kept the same as the status before RLD treatment, with negligible decrease of surface hardness All references, including publications, patent applications, and patents, cited herein are hereby incorporated by reference to the same extent as if each reference were individually and specifically indicated to be incorporated by reference and were set forth in its entirety herein.

The use of the terms "a" and "an" and "the" and "at least one" and similar referents in the context of describing the disclosed subject matter (especially in the context of the following claims) are to be construed to cover both the singular and the plural, unless otherwise indicated herein or clearly contradicted by context. The use of the term "at least one" followed by a list of one or more items (for example, "at least one of A and B") is to be construed to mean one item selected from the listed items (A or B) or any combination of two or more of the listed items (A and B), unless otherwise indicated herein or clearly contradicted by context. The terms "comprising," "having," "including," and "containing" are to be construed as open-ended terms (i.e., meaning "including, but not limited to,") unless otherwise noted. Recitation of ranges of values herein are merely intended to serve as a shorthand method of referring individually to each separate value falling within the range, unless otherwise indicated herein, and each separate value is incorporated into the specification as if it were individually recited herein. All methods described herein can be performed in any suitable order unless otherwise indicated herein or otherwise clearly contradicted by context. The use of any and all examples, or example language (e.g., "such as") provided herein, is intended merely to better illuminate the disclosed subject matter and does not pose a limitation on the scope of the invention unless otherwise claimed. No language in the specification should be construed as indicating any non-claimed element as essential to the practice of the invention.

Certain embodiments are described herein. Variations of those embodiments may become apparent to those of ordinary skill in the art upon reading the foregoing description. The inventors expect skilled artisans to employ such variations as appropriate, and the inventors intend for the embodiments to be practiced otherwise than as specifically described herein. Accordingly, this disclosure includes all modifications and equivalents of the subject matter recited in the claims appended hereto as permitted by applicable law. Moreover, any combination of the above-described elements in all possible variations thereof is encompassed by the disclosure unless otherwise indicated herein or otherwise clearly contradicted by context.

The invention claimed is:

1. A method of remotely desensitizing a metal alloy sample, the method comprising:

irradiating a first region of a surface of a metal alloy sample with a laser beam, wherein irradiation from the laser beam heats the first region to a local temperature between a solvus temperature and an annealing temperature of the metal alloy sample, without heating the bulk of the metal alloy sample, to reduce a degree of sensitization of the region of the metal alloy sample, wherein the metal alloy sample comprises an aluminum (Al) alloy.

2. The method of claim 1, further including scanning the laser beam across the surface of the metal alloy sample to reduce a degree of sensitization in additional regions of the metal alloy sample.

3. The method of claim 2, wherein the irradiation from the laser beam heats the region to the local temperature within a certain timeframe, and wherein scanning includes moving the laser beam to a second region different than the first region after a period of time equal to the timeframe has elapsed.

4. The method of claim 3, wherein the second region is contiguous with or abuts the first region.

5. The method of claim 1, wherein the first region of the surface of the metal alloy sample is irradiated by the laser beam directly or through one or more coating layers.

6. The method of claim 5, wherein the one or more coating layers includes a temperature-resistant paint or a nonskid layer.

7. The method of claim 1, wherein the irradiating a first region of a surface of a metal alloy sample with a laser beam includes exposing the first region of the surface of the metal alloy sample to controlled scanning laser beam irradiation having an average laser output power over 100 W or an output laser pulse energy over 50 mJ.

8. The method of claim 7, wherein the first region of the surface of the metal alloy sample is exposed to the laser beam irradiation directly or through one or more coating layers.

9. The method of claim 8, wherein the one or more coating layers includes a temperature-resistant paint or a nonskid layer.

10. The method of claim 7, wherein the controlled scanning laser beam irradiation locally heats an entire thickness of the metal alloy sample at a desired location, which keeps the local temperature of this laser heated region between the solvus temperature and the annealing temperature of the metal alloy sample to reduce the degree of sensitization of the metal alloy sample at the desired location.

11. The method according to claim 7, wherein the local temperature of the laser heated region is configured to be between about 240° C. to 550° C. and last for about 1 microseconds to 60 seconds.

12. The method according to claim 7, wherein the laser beam delivers a laser spot with a diameter of between about 5 mm to 250 mm on the surface of the metal alloy sample.

13. The method according to claim 7, wherein the controlled scanning laser beam irradiation has a scanning speed of about 0.01 mm/s to about 50 m/s.

14. The method according to claim 1, wherein the laser beam is configured to reduce a degree of sensitization of the metal alloy sample in a layer at the surface of the metal alloy sample with a thickness from about 10 μm to an entire thickness of the metal alloy sample.

15. The method according to claim 1, wherein the laser beam is configured to locally heat the desired location of metal alloy sample having a depth of from about 10 μm to an entire thickness of the metal alloy sample.

16. The method according to claim 1, wherein the laser beam delivers a laser spot with a diameter of between about 5 μm to about 250 mm on the metal alloy sample surface.

17. The method according to claim 1, wherein a distance between an output window of a laser generating or emitting the laser beam and the metal alloy sample is between about 2 mm to about 100 m.

18. The method according to claim 1, wherein a distance between an output window of a laser generating or emitting the laser beam and the metal alloy sample is between about 0.5 m to about 100 m.

* * * * *